United States Patent [19]

Cellone et al.

[11] Patent Number: 4,477,564

[45] Date of Patent: Oct. 16, 1984

[54] PHOTOGRAPHIC SILVER HALIDE EMULSIONS, PROCESS FOR PREPARING THE SAME AND THEIR USE IN COLOR REVERSAL FILMS

[75] Inventors: Luigi Cellone; Marco Loiacono, both of Albissola Mare, Italy

[73] Assignee: Minnesota Mining and Manufacturing Company, St. Paul, Minn.

[21] Appl. No.: 364,206

[22] Filed: Apr. 1, 1982

[51] Int. Cl.³ ..... G03C 1/02; G03C 1/46; G03C 7/26

[52] U.S. Cl. ..... 430/567; 430/569; 430/503; 430/543

[58] Field of Search ..... 430/569, 567, 503, 543

[56] References Cited

U.S. PATENT DOCUMENTS

| | | | |
|---|---|---|---|
| 3,482,982 | 12/1969 | Miyata | 430/569 |
| 3,615,424 | 10/1971 | Johnson et al. | 430/364 |
| 4,045,228 | 8/1977 | Vanassche | 430/567 |
| 4,184,877 | 1/1980 | Maternaghan | 430/569 |
| 4,184,878 | 1/1980 | Maternaghan | 430/569 |
| 4,210,450 | 7/1980 | Corben | 430/569 |
| 4,259,438 | 3/1981 | Falxa | 430/569 |
| 4,334,013 | 6/1982 | Bergthaller et al. | 430/569 |
| 4,349,622 | 9/1982 | Koitabashi et al. | 430/567 |

FOREIGN PATENT DOCUMENTS 1027146 4/1966 United Kingdom .

OTHER PUBLICATIONS

Berry et al. "Coprecipitation of Silver Bromide with Silver Iodide and with Silver Chloride," Photo. Science and Technique II. 2 pp. 149–153 (1955).

Berry et al., "Silver Halide Precipitation," II., Photo. Science and Technique, Feb. 1957, pp. 22–26.

Hirsch, "Photographic Emulsion Grains with Cores," Part 1 and 2, Journal of Photo. Science, vol. 10, 1962, pp. 129–146.

*Primary Examiner*—Mary F. Downey

*Attorney, Agent, or Firm*—Donald M. Sell; J. A. Smith; Mark A. Litman

[57] ABSTRACT

Silver halide grains with high sensitivity are provided with iodobromide grains having at least 12% nominal iodide molar content, the grains including at least three different iodobromide phases having different iodide contents, the most external phase having an iodide content lower than the nominal iodide content.

19 Claims, No Drawings

PHOTOGRAPHIC SILVER HALIDE EMULSIONS, PROCESS FOR PREPARING THE SAME AND THEIR USE IN COLOR REVERSAL FILMS

TECHNICAL FIELD

The present invention relates to photographic silver halide emulsions and to a process for preparing the same. More particularly, this inventions relates to high iodide silver iodo-bromide emulsions having grains comprising several phases with different iodide content, which emulsions show a high light sensitivity.

BACKGROUND OF THE ART

It is well-known that increasing the iodide content of silver iodo-bromide emulsions causes morphological modifications of the grains, as well as modifications concerning their intrinsic sensitivity and their disposition to chemical sensitization. For example, G. F. Duffin, "*Photographic Emulsion Chemistry*", The Focal Press, 1966, page 64, refers to the effect of iodide on the rapidity of grain growth, as well as to the increased photographic speed and improved spectral sensitization. Also, P. Glafkidés, "*Chimie-et Physique Photographique*", Paul Montel, 1976, page 377, refers to the role of iodide in modifying the silver halide emulsion characteristics, mainly the photographic sensitivity, the necessary iodide content rarely exceding 5 moles percent.

In effect, when the iodide content excedes or equals 7–10 moles percent, the photographic sensitivity roughly decays.

SUMMARY OF THE INVENTION

It has been found that high-iodide silver iodo-bromide emulsions exhibit a high light sensitivity, without substantially showing increased grain dimensions, when such iodide is distributed within the grains in at least three iodo-bromide phases each having a different iodide content.

More particularly and preferably, said grains have a nominal (or average) iodide content of 12 to 25 percent (molar) and the first or external of said phases has an iodide content lower than the average iodide content of the entire grain (hereinafter referred to as "the nominal content"), preferably comprised between 5 and 15 percent. The second phase has preferably an iodide content higher than the nominal content, more preferably comprised between 15 and 25 moles percent and the third phase has preferably an iodide content higher than the second one, more preferably comprised between 30 and 70 moles percent. A fourth internal phase of pure iodide may be and often is normally associated with such three iodo-bromide phases.

DETAILED DESCRIPTION OF THE INVENTION

According to one aspect, the present invention relates to a high-sensitivity photographic emulsion consisting of high iodide silver iodo-bromide grains dispersed in gelatin, characterized by having said grains including at least three different iodo-bromide phases having different iodide contents. The differing contents are distinguishable upon step-by-etching X-ray diffraction analysis. The first or outermost phase has an iodide content lower than the nominal content. More particularly, the present invention refers to a high-sensitivity emulsion as hereinbefore described, characterized by having said grains including four phases each having a different iodide content, the first of said phases having an iodide content lower than the nominal content, the fourth being or approaching hundred percent iodide (e.g. 80–100 or 90–100 percent), the second and the third phase having intermediate iodide contents between said first and fourth phases. Preferably the present invention refers to a high-sensitivity emulsion as described above, wherein said second phase has an iodide content higher than the nominal content, said third phase having particularly and more preferably an iodide content higher than the second one.

In particular, the present invention refers to a high-sensitivity emulsion as hereinbefore described, wherein the silver iodo-bromide grains nominally contain 12 to 25 moles percent of iodide. Still particularly, it refers to a high-sensitivity emulsion as described, wherein the first phase contains 5 to 15 moles percent of iodide, and preferably the percent iodide content of said phase is 50 to 70 percent of the nominal percent iodide content of the silver iodo-bromide grains. More particularly, the present invention refers to a high-sensitivity emulsion as described, wherein the second phase contains 15 to 25 moles percent of iodide. Still more particularly, the present invention refers to a high-sensitivity emulsion as described, wherein the third silver iodo-bromide phase contains 30 to 70 moles percent of iodide.

According to another aspect, the present invention refers to a light-sensitive photographic element comprising a support having coated thereon at least one layer containing the silver iodo-bromide emulsion hereinbefore described associated with color-forming couplers. More preferably, the present invention refers to a photographic color film for reversal processing comprising a support having coated thereon at least one red-sensitive silver halide emulsion layer including cyan-image-forming couplers, at least one green-sensitive silver halide emulsion layer including magenta-forming couplers, a yellow filter layer and at least one blue-sensitive silver halide emulsion layer including yellow-image-forming couplers, wherein the blue-sensitive silver halide emulsion comprises the high-iodide silver iodo-bromide emulsion of the present invention.

According to a further aspect, the present invention refers to a process for preparing a high-sensitivity high-iodide silver iodo-bromide photographic emulsion which comprises the following sequential steps:

1. adding an aqueous high ammoniacal water-soluble silver salt solution into an aqueous alkali-metal or ammonium bromide and iodide gelatin solution to precipitate a mino quantity of total iodide at normal temperature;
2. digesting at high pH and high pAg to obtain coarse silver iodide nuclei;
3. continuous addition of the silver salt solution to the alkali-metal or ammonium bromide and iodide gelatin solution in low ammoniacal and high temperature conditions to precipitate all silver halide to form a mixture additionally including finer silver bromide and iodo-bromide grains;
4. digesting at pAg and pH near neutrality to obtain coarse silver iodo-bromide grains; and, as known in the art, removing any water-soluble salts from the emulsion and chemically sensitizing the emulsion.

The high-sensitivity emulsions of the present invention comprise silver iodo-bromide grains containing high percentages of nominal iodide, that is comprised between 12 and 25 moles percent, preferably between 14 and 18 percent and having said iodide distributed within the grains in at least 3 different iodo-bromide phases, as distinguishable at step-by etching X-ray analysis.

Such internal iodide distribution of the silver iodo-bromide grains of the present invention has been determined by using X-ray diffraction analysis. As known in the art, analysis of X-ray diffraction line profiles allows to individuate different phases present in silver iodo-bromide grains. The silver iodo-bromide grains with a uniform distribution give a symmetric (220) diffraction peak with a line width approaching the instrumental resolution. On the contrary, grains with variable iodide distribution give a broader diffraction peak with some skewing towards the low angle side of the line (corresponding to higher iodide content). Such line shapes, therefore, suggest non-uniformly distributed iodide, but give no information as to the presence of different phases within the grains and to their composition. Such information can be obtained by a technique, as described herein, consisting of a step controlled dissolution (step-by-etching) of the grains with diluted silver halide dissolving (fixer) solutions, each etching being followed by X-ray measurements of the lattice parameters to evidentiate different iodide phases within the grains.

The emulsions were, more precisely, treated and analyzed according to the following procedure:

i. the silver iodo-bromide gelatin emulsion was enzyme hydrolized by mixing 0.1 grams of the emulsion with 10 ml. of 25% seryzime in a centrifuge tube and heated at 40°-50° C. for 30 minutes. The mixture was centrifugated at 3,000 r.p.m. for 10 minutes, the supernatant liquor discharged and the tube drained by inversion;

ii. the silver halide grains were suspended in 10 ml. of deionized water at 40°-50° C. washed by centrifuging and again drained by inversion. Washing was repeated three times. After the last washing, the grains were re-suspended in 2.5 ml. of deionized water;

iii. a portion (0.1≃0.2 ml.) of the mixture was applied on a 4×4 cm. glass slide; the specimen was heated at 40°-50° C. until dry;

iv. the X-ray diffraction pattern was measured on this specimen and the measurements repeatedly made on the same specimen each time after immersing it horizontally into a 0.2 M sodium thiosulfate solution for 5 minutes, then into deionized water for 2 minutes and dried at 30° to 40° C. (ammonium thiosulfate could also be used).

The X-ray diffraction pattern was registered by using a Siemens Kristalloflex IV powder diffractometer, having an X-ray tube with a copper anticathode, a receiving slit 0.2 mm. wide and a powdered silicon specimen as external standard. The diffraction curves were registered in two scanning ranges, respectively 42° to 47° and 22° to 25° ($2\theta$) at respective scanning speeds of 0.25 and 1 degree/minute and chart recorder speeds of 2400 and 600 mm/h.

The lattice parameters were derived from the observed reflection angles $\theta$ with the aid of the Bragg law: $a_o=\lambda/2.\sqrt{h^2.K^2+1^2}/\sin\theta$, wherein $\lambda=1.5405$ Å (Cu $K_L$ radiation); h, K, 1=Miller indices; $\theta$=reflection angle measured at the center of gravity of the diffraction lines. Starting from $a_o$ value of pure AgBr=5.77475 Å, I% was calculated from the lattice constant shift $\Delta a_o$ through the relationship $I\%=\Delta a_o/0.00346$ (I equals iodide).

As applied to the purposes of the present invention, the above step-by-etching X-ray diffraction analysis method proved to be sufficiently good to indicate the number of phases present within the grains and the percent iodide content of each of said phases even if the precision of the measurements was apparently affected, to some extent, by the broadening of the diffraction peaks. It can be observed that the described step-by-etching analysis method is likely to preferentially describe the bigger grains rather than the smaller ones, but such bigger grains are believed to be those of primary importance in obtaining high-sensitivity emulsions.

In the above, a description of the crystal phase distribution has been given by measuring the relative intensities (by assuming equal to 100 the intensity of the main diffraction peak) of the X-ray diffraction curve, as registered on the sample before etching, at $2\theta$ values determined by the above described step-by-etching X-ray diffraction analysis method. Each of said determined $2\theta$ values, the presence of which is believed to be the main characteristics of the silver halide grains for use according to the present invention, can be assumed to be corresponding to a single phase within the grains of interest to the present invention. It can also be assumed, on the basis of the process of manufacturing such grains, that lower $2\theta$ angles, that is lower iodide containing phases, are outwardly disposed on the grains (i.e. externally located) with respect to higher $2\theta$ angles, that is higher iodide containing phases. This appears to be reasonable to the expert in the art, and proves to be useful in describing the silver grains of the present invention in terms of phases each having a certain iodide percent and location within the grains.

As a further parameter to characterize the silver halide grains of the present invention, the percent difference of the iodide percent ($\Delta I\%$) calculated on the main diffraction peak (outern phase) with respect to the nominal iodide percent value, has been considered.

The high-sensitivity high-iodide silver iodo-bromide emulsion of the present invention can be prepared with a single-jet techinque by:

1. gradually adding an aqueous ammoniacal solution of water-soluble silver salt, preferably silver nitrate, to an aqueous alkali metal or ammonium bromide and iodide gelatin solution, at high pH (e.g., higher than 9, more preferably higher than 11, most preferably higher than 12) and high pAg (e.g., higher than 8, more preferably higher than 10, most preferably higher than 12), so that a minor quantity (more preferably comprised between 5 and 50 percent molar, most preferably between 7 and 15 percent) of total iodide is precipitated at a "normal" temperature preferably comprised between 40° and 60° C.;
2. digesting the precipitated crystals at high pH and high pAg for a time and at a temperature necessary to obtain coarse silver iodide nuclei having medium diameters of 0.6-0.7 micron;
3. continuing the addition of the silver salt solution to the alkali metal or ammonium bromide and iodide solution at a lower pH (preferably lower than 9, most preferably lower than 8) at a high temperature (preferably higher than 70° C., most preferably higher than 80° C.); during this addition fine silver bromide and silver iodo-bromide crystals precipitate in addition to the performed silver iodide nuclei and pAg lowers to values less than 9;

4. digesting the mixture of crystals at the above high temperature, at pH near to neutrality (more preferably between 6.5 and 7.5, most preferably about 7) at pAg near to the equivalence (more preferably less than 9, most preferably about 8), for a time necessary to obtain coarse silver bromo-iodide grains having medium diameters of 0.9–1.3 micron; and then, as known in the art,
5. removing any water-soluble salt by rinsing: the resulting silver iodo-bromide dispersion in gelatin is allowed to set by chilling and is shredded and washed with water or is coacervated by adding a silver soap, washed with water and redispersed, or alternatively is flocculated by adding an acid substituted gelatin and lowering the pH, washed with water and redispersed; and finally
6. chemically sensitizing at normal temperatures, preferably at a temperature between 50° and 60° C., most preferably at about 55° C., at pH and pAg near neutrality, preferably with a gold compound and a sulfur sensitizing agent or a reduction sensitizing agent as described for instance in C. E. K. Mees and T. H. James, *The Theory Of The Photographic Process,* third edition, 114–116, MacMillan Co. (1966), for a period sufficient to reach the maximum sensitivity.

As the skilled in the art can understand from the above description, the method of preparing the silver halide grains of the present invention is characterized by having, in a single jet preparation of an iodo-bromide emulsion, the first precipitation made at normal temperature in high ammoniacal conditions to precipitate a minor part of the iodide as silver iodide and the second precipitation made in low ammoniacal high temperature conditions (each of said precipitations being followed by digestion at similar conditions of the previous precipitation). The skilled in the art may well understand the terms high ammoniacal, low ammoniacal, normal and high temperature, but it may be useful to indicate that normal temperatures may range from 40° to 60° C., while high temperature range between 70° C. and the maximum practicable and economical temperature values, preferably lower than 85° C. and higher than 80° C.

Also high ammoniacal conditions are known to correspond to a pH of at least 10. Preferred pH values for the purposes of the present invention (in the first precipitation) are higher than 11 and most preferred values are higher than 12. Low ammoniacal conditions are known to correspond to pH values no higher than 9. Preferred pH values within the method of the present invention (in the second precipitation) are values lower than 9, more preferably lower than 8 and most preferably near to neutrality. The digesting temperature and pH conditions can be usefully established near to the respective prior precipitation conditions. Other conditions such as pAg and the presence of particular additives, such as solvent of the silver halide, as for example alkali or ammonium chloride, can be set up, as known, to obtain the desired results. The pAg is kept high, as described, during the first precipitation and digestion in the presence of chloride ions to get a low quantity of coarse silver iodide while, during the second precipitation, the pAg is continuously diminished to the final value as long as the soluble silver salt solution is added.

To the purpose of obtaining the high-sensitivity silver iodo-bromide photographic emulsions of the present invention, it is believed, as indicated by experiments, that mainly the single-jet addition, the pH (high or low ammoniacal) values during the precipitation steps and the quantity of iodide precipitated in the first step have an influence on the obtained results. As a matter of fact, it has been seen that the double-jet addition, in similar conditions, of a little quantity of silver salt solution and an equivalent of iodide salt solution to a bromide salt gelatin high ammoniacal solution, followed by digestion, second low ammoniacal precipitation of all iodide and bromide salts and second digestion, resulted in a very low sensitivity photographic silver iodo-bromide emulsion.

Particularly, it has been seen that single jet addition of ammoniacal silver salt solution to the bromide and iodide salt gelatin solution to precipitate in one step all silver salts, followed by digestion also resulted in a very low sensitivity emulsion. It has been also seen that quantities of iodide precipitated in the first step higher than 50 percent with respect to the total iodide resulted in a lower sensitivity. Percent quantities of first precipitated iodide lower than 50 gave speed characteristics higher than conventional but the highest speed values have been obtained with said percent quantities around 10 percent.

As explained above, the silver halide grains of the present emulsions can be described as coarse silver bromo-iodide grains for use in photography having a high content of iodide, characterized by including different phases at different iodide content. The first or most external of said phases is preferably silver bromo-iodide including iodide in quantity lower than the nominal content and the second and third phases are silver bromo-iodide having an iodide content higher than the nominal content. A fourth phase of pure iodide is also present even if this phase has been observed to be minor in quantity. The presence of this iodide phase, per se, is not believed to be connected with good properties of the grains of the present invention, because some tests made on high iodide grains having a silver iodide core but no silver bromo-iodide intermediate phases, as described, was not found to have high sensitivity properties.

While the presence of a phase including pure iodide is believed to be of minor importance to the good properties of the grains of the present invention, it being considered a side effect more than a need, the presence of at least three iodo-bromide phases within the grains, as described, is believed to be essential to the purposes of the present invention.

The relative quantities of said phases within the grains is not believed to be critical to the present invention. We can positively say, however, that they have been evaluated with the step-by-etching analysis method of the present invention by measuring the peaks on the difractometric curve of the non-etched grain sample at angles determined by etching, as described. The peak at the first highest $2\theta$ angle value turned out to be normally higher than the peaks at lower (2nd and 3rd) values and the 2nd peak turned out to be higher than the 3rd one (the peak corresponding to pure iodide normally turned out not to be evaluable in its contribution to the difractometer curve because being a much minor part of the grain).

The high-iodide silver iodo-bromide emulsion according to the present invention is suitable to provide photographic materials with a very high light sensitivity. A photographic material comprising a high-iodide silver iodo-bromide gelatin emulsion layer provided by the present invention, coated onto a proper support base, image-wise exposed to visible radiation and developed in conventional black and white and color developers, exhibits a very high light sensitivity with a very high quality image. While in the art it is known that the sensitivity of photographic films can be increased by increasing the dimensions of the silver halide grains, thus causing however a worsening of the image quality (granularity, resolving power), the high-sensitivity high-iodide silver iodo-bromide emulsion of the present invention affords higher sensitivity without substantially increasing silver halide grain dimensions, if compared with commercially used photographic emulsions.

The high-iodide silver iodo-bromide emulsion according to the present invention is advantageously applied to a variety of light-sensitive photographic materials, such as those for X-ray, color image, black-and-white image, transfer process, high contrast photography and photothermography. This emulsion is particularly useful in photographic color materials, i.e. materials which include a dye-image forming coupler, i.e. a compound capable of reacting with the oxidation product of an aromatic amine developing agent to form a dye.

This emulsion is more particularly useful in photographic color materials for reversal processing comprising a conventional support, such as cellulose esters, polyester film, polyvinyl acetal film, polycarbonate film, etc., having coated thereon at least two silver halide emulsion layers which have been sensitized to particular regions of the spectrum. These emulsions have incorporated therein color forming couplers, which combine with the oxidation product of the photographic color developers to produce the desired color images. For example, a typical color film, useful in practicing the present invention, comprises a support having coated thereon a red-sensitized photographic silver halide emulsion having incorporated therein a coupler for the cyan image (e.g. a phenolic coupler), a green-sensitized photographic silver halide emulsion having incorporated therein a coupler for the magenta image (e.g. pyrazolone coupler), and a blue-sensitized photographic silver halide emulsion according to the present invention, containing a coupler for the yellow image (e.g. a coupler containing an openchain ketomethylene group). The photographic element can also contain conventional interlayers and filter layers, such as a yellow filter layer beneath the blue-sensitized emulsion to prevent exposure by blue light to either the red- or green-sensitized emulsion. Exposed photographic color films of the above-described type can be processed with the usual type of black-and-white developer for producing a negative silver image, followed by reversal re-exposure and subsequent color development, or followed by treatment with an aqueous nucleating agent and subsequent color development, or still alternatively followed by treatment with the color developer to which has been added a nucleating agent.

Particularly, it has been found that the grains of the present invention are useful in manufacturing blue-sensitive gelatin emulsion layers coated on a filter layer coated on a conventional green magenta forming layer which resulted in a sensitivity higher than expected. The transparency of the high iodide iodo-bromide emulsions is known to be higher than the transparency of the low iodide emulsions, but only minor improvements of sensitivity were expected.

The speed increase obtained in the green-sensitive layer under the yellow filter appears to be very significant to the purposes of obtaining a high speed color reversal film having a good color balance. The rise in sensitivity in the magenta layer under the yellow filter was in fact found to occur without any worsening in color balance and apparently the emulsion of the present invention was highly absorptive of blue with higher transparency to green. No effects on the red sensitive layer under the green-sensitive layer were seen.

The silver halide grains of the present invention may be spectrally sensitized by contacting them with an effective concentration of the selected spectral sensitizing dyes dissolved in a proper dispersing solvent, such as methanol, ethanol, acetone, water and the like; all according to the traditional procedures of the art, as described in F. M. Hamer, *The Cyanine Dyes And Related Compounds.*

Additional optional additives, such as coating aids, hardeners, viscosity-increasing agents, stabilizers, antifoggants, preservatives, UV-absorbers, matting agents, and the like, also may be incorporated in the emulsion formulation, according to the conventional procedures known in the photographic emulsion manufacturing art.

EXAMPLE 1

The following solutions were prepared at the indicated temperatures:

| | |
|---|---|
| Solution A at 55° C.: | |
| distilled water | 453 ml |
| potassium bromide | 105.5 g. |
| potassium iodide | 23.9 g. |
| potassium chloride | 11 g. |
| gelatin | 22.5 g. |
| Solution B at 20° C.: | |
| 12 N ammonia | 169 ml. |
| silver nitrate | 2.30 g. |
| Solution C at 20° C. | |
| 25% $H_2SO_4$ | 362.5 ml. |
| Solution D at 10° C. | |
| gelatin | 45.5 g. |
| water | 91 ml. |
| Solution E at 80° C. | |
| distilled water | 1,500 ml. |
| silver nitrate | 167.5 g. |
| Solution F at 10° C. | |
| distilled water | 147 ml. |
| gelatin | 78 g. |

Solution B was jetted with stirring into a kettle containing solution A over a 5 minute time so that 9.37% of the total silver iodide was precipitated. The precipitated crystals were digested into the ammonia solution at a 12.8 pAg and 55° C. for 15 minutes, thus obtaining coarse silver iodide nuclei having the distribution of grain diameters with $\Phi=0.649\mu$. Then the pH was adjusted to 7.6 with solution C and solution D was added. The temperature was brought to 81° C., solution E was jetted into the kettle in 30 minutes and held 40 minutes at 81° C. The emulsion was flocculated using carbamoylated gelatin and lowering the pH to 4.2, washed with water, then reconstituted by adjusting the pH to 6.5 and adding solution F. The resulting emulsion was brought to pH 6.8 and pAg 8.70 and digested with gold and thiosulfate at 55° C. to the maximum sensitivity: the silver iodobromide grains contained 14.4% moles of silver iodide with the distribution of grain diameters having $\Phi=1.172\mu$ (Emulsion no. 4). According to the same procedure, other emulsions (1 to 3 and 5 to 8), respectively containing 7, 10, 12, 16, 18, 22 and 30 percent moles of silver iodide in the silver bromo-iodide grains were prepared.

To comparison purposes, a silver iodo-bromide grain emulsion containing 7 percent moles of silver iodide was prepared according to the well-known Trivelli and Smith single-jet technique and digested as said above. Each digested emulsion was added with an oil dispersion of α-pivalyl-α-3-chloro-1,2,4-triazolyl-5-[γ-2,4-ditert.-amylphenoxybutylamido]-2-chloro-acetanilide yellow coupler and coated on a subbed cellulose triacetate support base at a coating weight of 20 mg/dm$^2$ of silver and 18 mg/dm$^2$ of gelatin (em. 9). each emulsion layer was then overcoated with a gelatin protective layer of 13 mg/dm$^2$ of gelatin.

Samples of the obtained film were stored for 15 hours at 50° C., image-wise exposed to white light (2850° K.) for 0.05 seconds and developed in Kodak $E_6$ processing line for color reversal materials at 38° C. The obtained speed values are reported in Table 1.

TABLE 1

| Film | AgJ M % | Shoulder speed | Speed point |
|---|---|---|---|
| 1 | 7 | 100 | 100 |
| 2 | 10 | 95 | 85 |
| 3 | 12 | 155 | 191 |
| 4 | 14.4 | 263 | 295 |
| 5 | 16 | 309 | 309 |
| 6 | 18 | 229 | 437 |
| 7 | 22 | 316 | 427 |
| 8 | 30 | 138 | 60 |
| 9 | 7 | 54 | 41 |

The following table reports the results of the described step-by-etching X-ray diffractometer analysis on films 4 and 6 having, respectively, nominal iodide percent quantities of 14.4 and 18.

Film 4
(I % nominal = 14.4)

| | °2θ | I % | Rel. intensity | ΔI % |
|---|---|---|---|---|
| 1st | 44.092 | 8.5 | 100 | 59 |
| 2nd | 43.751 | 20.9 | 45 | — |
| 3rd | 43.221 | 40.6 | 15 | — |
| 4th | 23.700 | 100 | negligible | — |

Film 6
(I % nominal = 18)

| | °2θ | I % | Rel. intensity | ΔI % |
|---|---|---|---|---|
| 1st | 44.005 | 11.6 | 100 | 64 |
| 2nd | 43.726 | 21.8 | 46 | — |
| 3rd | 43.179 | 42.2 | 15 | — |
| 4th | 27.700 | 100 | negligible | — |

EXAMPLE 2

To comparison purposes a silver iodo-bromide emulsion, outside the present invention, containing 14% moles of silver iodide was prepared using the following solutions and double-jet procedure:

| | |
|---|---|
| Solution A | |
| distilled water | 284 ml |
| potassium bromide | 105.5 g |
| potassium chloride | 11 g |
| gelatin | 22.5 g |
| Solution B | |
| 12 N ammonia | 169 ml |

-continued

| | |
|---|---|
| silver nitrate | 2.30 g |
| Solution C | |
| distilled water | 170 ml |
| potassium iodide | 2.2 g |
| Solution D | |
| distilled water | 91 ml |
| gelatin | 45.5 g |
| Solution E | |
| distilled water | 1,200 ml |
| silver nitrate | 167.7 g |
| Solution F | |
| distilled water | 300 ml |
| potassium iodide | 21.7 g |

Solutions B and C were jetted into a kettle containing solution A over a period of 5 minutes. The precipitated crystals were digested at 55° C. for 15 minutes. The the pH was adjusted to 7.7 with sulfuric acid and solution D was added. The temperature was brought to 81° C. in 7 minutes and solutions E and F were jetted into the kettle over a period of 30 minutes. The emulsion was held 40 minutes at 81° C., then flocculated, washed and reconstituted as described in Example 1. The step-by-etching analysis of the grains of the emulsions revealed the presence of a minor pure silver iodide core and only one major bromo-iodide phase having 13.4 percent of iodide. Emulsion A was digested to the maximum speed and coated as described in Example 1. The obtained film was exposed and developed as described in Example 1. The sensitometric speed is reported in the following table in comparison with film 4 of Example 1.

TABLE 2

| Film | AgJ % moles | Shoulder speed |
|---|---|---|
| 4 | 14.4 | 100 |
| A | 14 | 2 |

EXAMPLE 3

The high-iodide content (18% mole silver iodide) silver iodo-bromide emulsion described in British Pat. No. 569,495 (Example 1) was prepared for use as reference (B) in comparison with emulsion no. 6 of Example 1 of the present invention having the same silver iodide content.

The Emulsion was digested to the maximum speed and coated as described in Example 1. The sensitometric speeds of both film 6 and film B are reported in the following table:

TABLE 3

| Film | AgJ % moles | Shoulder speed |
|---|---|---|
| 6 | 18 | 100 |
| B | 18 | 19 |

EXAMPLE 4

A multilayer color photographic film (Film C) was prepared by coating a subbed cellulose acetate support base with the following layers in the indicated order:

First layer:

A black silver gelatin antihalo layer.

Second and third layers:

Two conventional red-sensitive silver bromo-iodide (containing 7% moles of silver iodide) gelatin emulsion layers at a total silver coverage of 147 mg/dm$^2$ and total gelatin coverage of 279 mg/dm$^2$ containing the oil dispersed cyan-dye forming couplers 1-hydroxy-2-[δ-(2',4'-ditert.-amylphenoxy)-n-butyl]-naphthamide and 2α-(2',4'-ditert.-amylphenoxy)-n-butyrylamino-4,6-dichloro-5-methyl-phenol.

Fourth layer:

A gelatin intermediate layer.

Fifth and sixth layers:

Two conventional green-sensitive silver bromo-iodide emulsion gelatin layers (containing 7% mole silver iodide) at a total silver coverage of 113 mg/dm$^2$ and total gelatin coverage of 178 mg/dm$^2$ containing the oil dispersed magenta-dye forming coupler 1-(2',4',6'-trichlorophenyl)-3-[3''-(2'''4'''-ditert.-amylphenoxyacetamido)-benzamido]-5-pyrazolone.

Seventh layer:

Yellow colloidal silver gelatin filter layer.

Eigth and ninth layers:

Two conventional blue-sensitive silver bromo-iodide emulsion gelatin layers (containing 7% mole silver iodide) at a total silver coverage of 144 mg/dm$^2$ and total gelatin coverage of 311 mg/dm$^2$ containing the oil dispersed yellow-dye forming coupler α-pivalyl-α-3-chloro-1,2,4-triazolyl-5-[γ-2,4-ditert.-amylphenoxybutyramido]-2-chloro-acetanilide.

Tenth layer:

A gelatin protective layer containing incorporated a gelatin hardener.

A second multilayer color photographic film (Film D) was prepared similarly to film A with the only difference that the eigth and ninth layers are substituted by a single blue-sensitive silver bromo-iodide gelatin layer including emulsion no. 4 of Example 1.

Samples of the two films were exposed and developed as described in Example 1. The speed values are reported in the following table.

TABLE 4

| Film | Moles % of AgJ in the blue emulsion | Speed | | |
|---|---|---|---|---|
| | | cyan | magenta | yellow |
| C | 7 | 100 | 100 | 100 |
| D | 14 | 100 | 123 | 162 |

We claim:

1. High-sensitivity photographic emulsion consisting of silver iodo-bromide grains having at least 12% nominal iodide mole percent dispersed in gelatin characterized by having said grains including at least three different iodo-bromide phases having different iodide contents, the most external phase having an iodide content lower than the nominal iodide content.

2. High-sensitivity photographic emulsion consisting of silver iodo-bromide grains dispersed in gelatin of claim 1 characterized by having said grains including four phases having different iodide contents, the first of said grain phases having an iodide content lower than the nominal iodide content and the fourth of said phases being hundred percent iodide, the second and third phases having iodide contents higher than the nominal iodide content.

3. High-sensitivity photographic emulsion consisting of silver iodo-bromide grains dispersed in gelatin of claims 1 or 2, wherein the silver iodo-bromide emulsion nominally contains 12 to 25 moles percent of iodide.

4. High-sensitivity photographic emulsion consisting of silver iodo-bromide grains dispersed in gelatin of claims 1 or 2, wherein the first silver iodo-bromide phase contains 5 to 15 moles percent of iodide.

5. High-sensitivity photographic emulsion consisting of silver iodo-bromide grains dispersed in gelatin of claims 1 or 2 wherein the second silver iodo-bromide phase contains 15 to 25 moles percent of iodide.

6. High-sensitivity photographic emulsion consisting of silver iodo-bromide grains dispersed in gelatin of claims 1 or 2 wherein the third silver iodo-bromide phase contains 30 to 70 moles percent of iodide.

7. High-sensitivity photographic emulsion consisting of high-iodide silver iodo-bromide grains dispered in gelatin of claim 3 wherein the percent iodide content of the first silver iodo-bromide phase is 50 to 70 percent of the nominal percent iodide content of the silver iodo-bromide emulsion.

8. High-sensitivity photographic emulsion consisting of high-iodide silver iodo-bromide grains dispersed in gelatin of claim 4 wherein the percent iodide content of the first silver iodo-bromide phase is 50 to 70 percent of the nominal percent iodide content of the silver iodo-bromide emulsion.

9. High-sensitivity photographic emulsion consisting of silver iodo-bromide grains dispersed in gelatin of claim 2, wherein the percent iodide content of the first silver iodo-bromide phase is 50 to 70 percent of the nominal percent iodide content of the silver iodo-bromide emulsion, the second silver iodo-bromide phase contains 15 to 25 moles percent of iodide and the third silver iodobromide phase contains 30 to 70 moles percent of iodide.

10. A light-sensitive photographic element comprising a support having coated thereon at least one layer comprising the silver iodo-bromide emulsion of claims 1 or 2 associated with color-forming couplers.

11. A light-sensitive photographic element comprising a support having coated thereon at least one layer comprising the silver iodo-bromide emulsion of claim 4 associated with color-forming couplers.

12. A light-sensitive photographic element comprising support having coated thereon at least one layer comprising the silver iodo-bromide emulsion of claim 5 associated with color-forming couplers.

13. A light-sensitive photographic element comprising a support having coated thereon at least one layer comprising the silver iodo-bromide emulsion of claim 9 associated with color forming couplers.

14. A photographic color reversal film comprising a support having coated thereon at least one red-sensitive silver halide emulsion layer including cyan-image forming couplers, at least one green-sensitive silver halide emulsion layer including magenta-image forming couplers, a yellow filter layer and at least one blue-sensitive silver halide emulsion layer including yellow-image forming couplers, wherein the blue-sensitive silver halide emulsion is the high-iodide silver iodo-bromide emulsion of claims 1 or 2.

15. A photographic color reversal film comprising a support having coated thereon at least one red-sensitive silver halide emulsion layer including cyan-image forming couplers, at least one green-sensitive silver halide emulsion layer including magenta-image forming couplers, a yellow filter layer and at least one blue-sensitive silver halide emulsion layer including yellow-image forming couplers, wherein the blue-sensitive silver halide emulsion is the high-iodide silver iodo-bromide emulsion of claim 4.

16. A photographic color reversal film comprising a support having coated thereon at least one red-sensitive silver halide emulsion layer including cyan-image forming couplers, at least one green-sensitive silver halide emulsion layer including magenta-image forming couplers, a yellow filter layer and at least one blue-sensitive silver halide emulsion layer including yellow-image forming couplers, wherein the blue-sensitive silver halide emulsion is the high-iodide silver iodo-bromide emulsion of claim 5.

17. A photographic color reversal film comprising a support having coated thereon at least one red-sensitive silver halide emulsion layer including cyan-image forming couplers, at least one green-sensitive silver halide emulsion layer including magenta-image forming couplers, a yellow filter layer and at least one blue-sensitive silver halide emulsion layer including yellow image forming couplers, wherein the blue-sensitive silver halide emulsion is the high-iodide silver iodo-bromide emulsion of claim 9.

18. A process for preparing a high-sensitivity high-iodide silver iodo-bromide photographic emulsion which comprises the following sequential steps:

(1) adding an aqueous ammoniacal water-soluble silver salt solution into an aqueous alkali metal or ammonium bromide and iodide gelatin solution to precipitate a minor quantity of total iodide;

(2) digesting at pH higher than 9 and pAg higher than 8 to obtain coarse silver iodide nuclei;

(3) continuing the addition of the water-soluble silver salt solution to the alkali metal or ammonium bromide and iodide solution in low-ammoniacal and high temperature conditions to precipitate all silver halide in finer silver bromide and iodo-bromide grains;

(4) digesting at pAg and pH near neutrality to obtain coarse silver iodo-bromide grains;

(5) removing any water-soluble salts from the emulsion; and (6) chemically sensitizing the emulsion.

19. A high-sensitivity photographic emulsion comprising silver iodo-bromide grains having at least 12% nominal iodide mole percent dispersed in gelatin characterized by said grains having at least three different iodo-bromide phases having different iodide contents, the most external phase having an iodide content lower than the nominal iodide content and the innermost phase consisting of pure silver iodide.

* * * * *